US009944882B2

(12) United States Patent
Braun et al.

(10) Patent No.: US 9,944,882 B2
(45) Date of Patent: Apr. 17, 2018

(54) WORKING FLUID FOR A STEAM CYCLE PROCESS

(71) Applicant: Fuchs Petrolub SE, Mannheim (DE)

(72) Inventors: Jürgen Braun, Speyer (DE); Dennis Ebert, Oftersheim (DE)

(73) Assignee: Fuchs Petrolub SE, Mannheim (DE)

( * ) Notice: Subject to any disclaimer, the term of this patent is extended or adjusted under 35 U.S.C. 154(b) by 0 days.

(21) Appl. No.: 15/021,915

(22) PCT Filed: Sep. 17, 2014

(86) PCT No.: PCT/DE2014/100336
§ 371 (c)(1),
(2) Date: Mar. 14, 2016

(87) PCT Pub. No.: WO2015/039649
PCT Pub. Date: Mar. 26, 2015

(65) Prior Publication Data

US 2016/0222313 A1 Aug. 4, 2016

(30) Foreign Application Priority Data

Sep. 17, 2013 (DE) ..... 10 2013 110 256

(51) Int. Cl.

| | |
|---|---|
| ***C09K 5/04*** | (2006.01) |
| ***C10M 169/04*** | (2006.01) |
| ***C10M 173/00*** | (2006.01) |
| ***F01K 25/06*** | (2006.01) |
| ***C10M 105/04*** | (2006.01) |
| ***C10M 129/16*** | (2006.01) |
| ***C10M 133/44*** | (2006.01) |
| ***C10M 173/02*** | (2006.01) |
| ***F01K 11/00*** | (2006.01) |
| ***F01K 23/06*** | (2006.01) |
| ***F01K 23/10*** | (2006.01) |

(52) U.S. Cl.

CPC ..... *C10M 169/04* (2013.01); *C10M 105/04* (2013.01); *C10M 129/16* (2013.01); *C10M 133/44* (2013.01); *C10M 173/00* (2013.01); *C10M 173/02* (2013.01); *F01K 11/00* (2013.01); *F01K 23/065* (2013.01); *F01K 23/10* (2013.01); *F01K 25/06* (2013.01); *C10M 2201/02* (2013.01); *C10M 2205/028* (2013.01); *C10M 2205/0285* (2013.01); *C10M 2207/021* (2013.01); *C10M 2207/126* (2013.01); *C10M 2209/104* (2013.01); *C10M 2209/105* (2013.01); *C10M 2215/08* (2013.01); *C10M 2215/086* (2013.01); *C10M 2215/28* (2013.01); *C10N 2250/02* (2013.01)

(58) Field of Classification Search

CPC .... C10M 2205/0285; C10M 2205/028; C10M 2203/1006; C09K 2208/34

See application file for complete search history.

(56) References Cited

U.S. PATENT DOCUMENTS

| | | | |
|---|---|---|---|
| 3,603,087 | A | 9/1971 | Burlland |
| 4,232,525 | A | 11/1980 | Enjo et al. |
| 6,653,355 | B1 | 11/2003 | Kasahara |
| 2008/0289662 | A1 | 11/2008 | Tindall |
| 2012/0117991 | A1 | 5/2012 | Rached |
| 2015/0240668 | A1 | 8/2015 | Hoetger et al. |

FOREIGN PATENT DOCUMENTS

| | | | |
|---|---|---|---|
| CA | 945383 | A | 4/1974 |
| DE | 2215868 | A | 10/1972 |
| DE | 102006052906 | A1 | 5/2008 |
| DE | 102008005036 | A1 | 3/2009 |
| DE | 102012008844 | A1 | 10/2012 |
| DE | 102012108468 | A1 | 3/2014 |
| EP | 0292526 | A1 | 11/1988 |
| GB | 1328932 | A | 9/1973 |
| JP | 2011063780 | A | 3/2011 |
| RO | 105345 | B1 | 12/1994 |

OTHER PUBLICATIONS

Ronald L. Shubkin "Polyalphaolefins", CRC Handbook of Lubrication and Tribology, (Jan. 1, 1993), pp. 219-236, XP009108705, tables 1-5.

International Search Report dated Dec. 17, 2014 for parent PCT application No. PCT/DE2014/100336.

International Preliminary Report on Patentability (Chapter II) dated Dec. 18, 2015 for parent application No. PCT/DE2014/100336.

*Primary Examiner* — John R Hardee

(74) *Attorney, Agent, or Firm* — D'Ambrosio & Menon, PLLC; Usha Menon

(57) ABSTRACT

The present invention relates to a working fluid for a steam-turbine cycle process, said fluid comprising a working medium, a lubricant and preferably an emulsifier. The working medium is a C1 to C4 alcohol and/or a C3 to C5 ketone, optionally mixed with water. The invention also relates to a device for a steam cycle process, which device contains the working fluid, and to the use of the working fluid in an organic Rankine cycle. The lubricant is a hydrocarbon and the emulsifier is a surface-active substance.

18 Claims, No Drawings

WORKING FLUID FOR A STEAM CYCLE PROCESS

PRIORITY CLAIM

This patent application is the U.S. National stage under U.S.C. 371 of PCT/DE2014/100336 filed Sep. 17, 2014, and designating the United States and claims priority to German Patent Application No.: DE 102013110256.5 filed Mar. 17, 2013.

FIELD OF THE INVENTION

The invention relates to working fluid for a steam cycle process comprising of a working medium, a lubricant, and preferably an emulsifier. The working medium is a C1 to C4 alcohol and/or a C3 to C5 ketone, if necessary mixed with water, a device for a steam cycle process containing the working fluid and the use of the working fluid in an organic Rankine cycle. The lubricant is a hydrocarbon and the emulsifier is a surface-active substance.

BACKGROUND

The organic Rankine cycle, abbreviated as "ORC", is a steam cycle process in which organic liquids not water vapor is used as the working medium. Unlike the conventional steam cycle process, the process is not connected to pressure and temperature, as they result from the vapor pressure of water. By using organic liquids with a lower boiling point lower than water, pressure and temperature can be set below the values, such as those found in steam power plants. The process is especially used if the available temperature gradient between the heat source for evaporation and heat sink for condensation is low or overall low operating temperatures are desired.

The steam cycle process comprises of at least one evaporator, an expander, a condenser and a circulation pump. According to a design, the expander is a compressor which is operated inversely, as a scroll compressor, reciprocating compressor, a radial piston machine or a turbine. It gains mechanical energy when the working medium is heated and evaporated in the evaporator by supplying heat from outside. By the expansion of the steam, an expander is operated and mechanical energy is produced. Subsequently, the working medium is cooled, liquefied in the condenser and fed back to the evaporator by means of a circulation pump. Thus, the circuit is closed. For example, the mechanical energy may be converted into electrical energy by a generator or mechanically led back to the drive train.

The working medium is guided in a closed circuit. The circuit includes moving parts and requires lubrication. Therefore, working fluid, which comprises of the working medium and a lubricant, is used. The use of working fluid comprising of a working medium and a lubricant in the steam cycle is noted.

According to U.S. Pat. No. 3,603,087 for example, water is used as the working medium with an organic lubricant such as glycol, polypropylene glycol, ether or polyglycol ether, in which the lubricant in the working medium is completely solvable. The solubility of the lubricant in the working medium causes increased the viscosity of the working medium.

DE 102008005036 A1 describes a device for waste heat utilization by means of an ORC process as part of an internal combustion engine with heat recovery. A solution of water with methanol and/or ethanol is proposed as a working medium.

From DE 2215868 A, a method for operating a power generating plant operated according to the Clausius Rankine cycle can be noted, in which trifluoroethanol and water and a lubricant are used as the working medium. The lubricant is preferably a hydrocarbon immiscible with the working medium.

From DE 102006052906 A1, a steam cycle is noted, which can be operated in the evaporator at temperatures above 170° C. The used working medium comprises of a C1 to C4 alcohol. The working medium may be mixed with a lubricant, which suitably indicates a condensation temperature above the steam outlet temperature, so that the lubricant is evaporated and condensed first in the expander.

Due to the closed circuit, it is necessary that the lubricant meets high requirements with regard to aging resistance. The present invention is therefore committed to providing working fluid, which includes a particularly suitable combination of working medium and lubricant, in which the lubricant should be thermally stable and is largely immiscible with the working medium of the cycle to ensure adequate lubrication of the expander.

Starting from the above-mentioned state of the technology, the primary objective of the present invention is to provide a working fluid composition from working medium and lubricant, which is thermally stable and long-term stability and suitable for the operation of an organic Rankine cycle, which utilizes the waste heat of an internal combustion engine. If the ORC is used in conjunction with an internal combustion engine, the high temperatures of the exhaust gas flow make big demands on the thermal stability of the working medium-lubricant mixture. The ORC should be usable and durable with an internal combustion engine in thermally highly-stressed devices like a heat exchanger in the exhaust system of a motor vehicle.

An expansion machine required to operate a lubricant, which is transported evenly through the ORC cycle together with the working medium and has a sufficiently high thermal and chemical stability.

The above objectives are achieved by a structure with the features of independent claim 1. Preferred embodiments are subject to the dependent claims or are described below.

The composition is a working fluid for a steam cycle comprising of a working medium (a), a lubricant (b) and optionally an emulsifier (c) and other optional components (d). The other optional components do not fall under (a), (b) or (c) and are attributed to the working fluid regardless of whether they are or could be working medium or part of the working medium at the same time.

Preferably, the working fluid consists exclusively of the working medium (a), the lubricant (b) and the optional emulsifier(s) (c) and of the optional component(s) (d), in the proportions given below, based on the working fluid, i.e. the proportions of (a), (b), (c) and (d) add up to 100% by weight.

Based on the total composition of the working medium, the working medium (a) consists of (a.1) at least one C1 to C4 alcohol, or (a.2) at least one C3 to C4 ketone or mixtures of (a.1) and (a.2) and (a.3) optionally up to 75% by weight of water, preferably up to 50% by weight of water.

The proportion of components (a1) to (a.3) at the working medium is calculated as follows in the (a.3) example of the water in % by weight:=(a.3)/((a.1)+(a.2)+(a.3))*100). In the calculation only the components (a.1), (a.2) and (a.3) are finally entered.

The proportion of the working medium (a) at the working fluid is preferably 99 to 60% by weight, particularly preferably 95 to 75% by weight and particularly preferably 90 to 80% by weight.

According to one invention design, there is no water in the working medium and according to another design e.g. 5 to 75% by weight of water, preferably 10 to 50% by weight of water, contained in the working medium. Apart from that, the working medium consists either only of components (a.1), only of components (a.2) or only of a mixture of components (a.1) and components (a.2).

In the C1 to C4 alcohol, C1 to C4 each denote a hydrocarbon radical with 1 to 4 carbon atoms, in particular, alkyl radicals such as, in particular methanol, ethanol, propanol or butanol and their positional isomers or mixtures. In the C3 to C4 ketone, C3 and C4 each denote a hydrocarbon radical with 3 or 4 carbon atoms such as acetone or methyl ethyl ketone or their mixtures.

The lubricant (b) consists of hydrocarbons and has a viscosity (kinematic viscosity) of 40 to 700 $mm^2/s$ at 40° C., preferably 100 to 400 $mm^2/s$ at 40° C., more preferably 150 to 300 $mm^2/s$ at 40° C. (measured according to DIN EN ISO 3104).

The boiling point of the lubricant, also in relation to a possible hydrocarbon mixture, is preferably greater than 300° C. (determined by gas chromatography according to DIN51435).

Suitable lubricants are e.g. alkylates, alkylated naphthalenes, mineral oils, or poly-alpha-olefins (PAO).

PAO and mixtures thereof are particularly preferred, e.g. combinations of low viscosity PAO like PAO 4, PAO 6, PAO 8 or PAO 10 (each with about 4, 6, 8 and 10 $mm^2/s$ at 100° C. measured according to DIN EN ISO 3104) and high viscosity PAO as PAO 40, mPAO 40, PAO 100, mPAO 100 (with each about 40 or 100 $mm^2/s$ at 100° C. measured according to DIN EN ISO 3104) or other available PAO qualities in the viscosity range between about 20 and 200 $mm^2/s$ at 100° C. measured according to DIN EN ISO 3104, where m represents PAOs polymerized by metallocene catalysis. Mixtures in particular of PAOs polymerized by metallocene catalysis from polymers of 2 to 12 C8-C20 alpha-olefin units are particularly preferred.

The proportion of the lubricant (b) at the working fluid is preferably 1 to 40% by weight, particularly preferably 5 to 25% by weight and particularly preferably 10 to 20% by weight.

The lubricant is not soluble within the working medium. Non-soluble here means in proportions of less than 5% by weight, preferably less than 2% by weight, at 25° C. As a result, there is no appreciable dilution of the lubricant and therefore only a small drop of the viscosity by the discharge.

Lubricants such as esters are unsuitable because of their thermal instability or reactivity, and therefore also because with alcohols at the temperatures encountered in the present process reactions between esters and alcohol take place.

The optionally used emulsifier (c) is in particular selected among the members of the following groups Alkenyl succinimides, preferably with a molecular weight of 500 to 10000 g/mol, particularly preferably 500 to 2500 g/mol (number average);

Alkenyl succinamides, preferably with a molecular weight of 500 to 10000 g/mol, particularly preferably 500 to 2500 g/mol (number average);

C8 to C24, preferably C10 to C18 fatty alcohol ether carboxylic acids with 2 to 10, particularly preferably 4 to 8, alkoxylate units, particularly preferably ethylene oxide and/or propylene oxide units (preferably only ethylene oxide), and their salts, particularly ammonium their salts, including alkanolammonium salts (e.g. with a C1 to C4 alkanol radical);

Alkoxylated C10 to C24, preferably C24 to C8, particularly preferably C10 to C18 fatty alcohols with 2 to 10, especially 4 to 8, alkoxylate units, particularly preferably ethylene oxide and/or propylene oxide units (preferably only ethylene oxide);

Alkoxylated alkylphenols, particularly alkoxylated C6 to 18 alkylphenols, particularly preferably C8 to C12 alkylphenols, in each case with 2 to 10, in particular 4 to 8, alkoxylate units, particularly preferably ethylene oxide and/or propylene oxide units (preferably only ethylene oxide), for example octyl or nonylphenol ethoxylate (4-8 EO); and their mixtures.

The emulsifier is preferably added during the manufacture of the working fluid together with the lubricant, e.g. by being homogenized with this.

When using alcohols as a component of the working medium or as a working medium, the aforementioned alkenyl succinimides and alkenyl succinimides, preferably polyisobutene succinimides, and the aforementioned alkoxylated fatty alcohols are preferred as emulsifiers.

The proportion of the emulsifiers is in total preferably greater than 0.0001 to 2% by weight, in each case based on the working fluid, and independently, but preferably cumulatively, from 0.01 to 5% by weight based on the lubricant.

The proportion of the optional components (d) is preferably greater than 0.0001% by weight, particularly preferably 0.0005 to 2% by weight, in each case based on the working fluid, and independently, but preferably cumulatively, greater than 0.01% by weight, particularly preferably 0.1 to 5% by weight based on the lubricant.

Suitable optional components include, for example antiwear agents, extreme pressure additives, antioxidants, nonferrous metal inhibitors and defoamers.

As antiwear agents (anti-wear) and EP-additives (Extreme Pressure), named after the following brief AW/EP additive, phosphorus or sulfur and phosphorus or sulfur containing compounds are also suitable. Suitable examples are tricresyl phosphate, tri (nonylphenyl) phosphite, dioleyl hydrogen phosphite, 2-Ethylhexyl diphenyl phosphite, diphosphate/triaryl phosphate, mono-substituted, di-substituted or tri-substituted on at least one aryl ring with t-butyl and/or isobutyl radicals as well as representatives of the class of di-thiophosphoryl acid esters. Besides phosphorous and phosphorus-sulfur-containing high pressure additives, pure sulphurous AW/EP additives are still usable.

The AW/EP additives can be used individually or in combination. The proportion of the AW/EP additives is preferably greater than 0.0001% by weight, particularly preferably 0.005 to 2% by weight, each based on the working fluid and independently, but preferably cumulatively greater 0.01% by weight, particularly preferably 0.1 to 5% by weight based on the lubricant.

For example, phenoic antioxidants such as 2,6-di-tert-butyl-4-methylphenol, 2,6-di-tert-butyl-4-ethylphenol and 2,2'-methylenebis (4-methyl-6-tert-butylphenol) and antioxidants of amine type, such as phenyl-alpha-naphthylamine, N, N'-diphenyl-p-phenylenediamine, and alkylated diphenylamines (alkyl=C4-C9). Phenolic antioxidants are particularly preferred.

The proportion of antioxidants is in total weight preferably greater than or equal 0.0001. % by weight, in particular from 0.0001 to 0.4% by weight, each based on the working fluid and independently, but preferably cumulatively, from greater than 0.01% by weight, and particularly preferably 0.01 to 1% by weight based on the lubricant.

As nonferrous metal inhibitors, triazoles can be used, preferably from thiadiazoles, benzotriazoles and tolyltriazole and their derivatives. The proportion of the non-ferrous metal inhibitors is preferably 0.0001 to 0.02% by weight, in each case based on the working fluid and independently, but preferably cumulatively, from 0.01 to 0.5% by weight based on the lubricant.

Furthermore, defoamers can still contain the working fluid as further components (d). As concrete additives of the aforesaid type, siloxanes, polyethylene glycols and polymethacrylates may be preferably mentioned.

According to one design, the working fluid consists exclusively of components (a) to (d), in which components (c) and (d) are optional, in which components (c) and (d) are optionally independent from one another.

In the steam cycle invention, a vaporizable organic liquid is used at least with a lower boiling point than water. The cycle includes at least one evaporator, an expander, a condenser and a circulation pump. The expander is preferably a compressor, which is operated inversely, like a scroll compressor, reciprocating compressor, a radial piston machine or a turbine. The system or the cycle is hermetically sealed to the outside. Preferably, the steam cycle is part of a motor vehicle, particularly a truck, with an internal combustion engine, in which the heat exchanger uses the waste heat of the engine and e.g. is coupled into the exhaust gas system of the internal combustion engine.

By the energy introduced in the heat exchanger from the exhaust gas flow, the working medium is evaporated. The heat exchanger functions as an evaporator. The mechanical power recovered by the expander is coupled into either the drive train of the motor vehicle, or drives a generator for generating electrical energy.

EXPERIMENTAL PART

Emulsifying Test

In order to investigate the effectiveness of emulsifiers, lubricant mixtures with a viscosity of 40° C. of 150 $mm^2/s$ from PAO 8, PAO 40 and the respective emulsifiers have been produced. 20 g of these lubricant mixtures were filled and closed respectively with 20 g working medium in a 50 ml test tube with screw cap and shaken at 20° C. for about 1 minute by hand. Afterwards, the test tube was mixed again for 1 minute on a test tube shaker at a frequency of 2200 Hz.

1 minute after turning off the test tube shaker, the phase behavior of the mixture as a measure of the emulsifying effect was evaluated qualitatively according to the following scheme:

0=no emulsifying properties

1=minimum emulsifying properties

2=good emulsifying properties

3=excellent emulsifying properties

Table 1 lists the emulsifiers used, Tables 2 to 6 show the results of emulsifying tests of respective lubricant mixtures with different working media.

TABLE 1

| Emulsifier | Product designation | Manufacturer | Chemistry |
|---|---|---|---|
| Emulsifier 1 | Hitec633 | Afton Chemicals | Polyisobutene succinimide, non-borated |
| Emulsifier 2 | C9231 | Infineum | Polyisobutene succinimide, borated |
| Emulsifier 3 | Marlipal013/80 | Sasol | Iso-tridecanol, ethoxylate |
| Emulsifier 4 | Marlipal24/60 | Sasol | C10/C12 alcohols, ethoxylated |
| Emulsifier 5 | Emulsogen ® | Clariant | C16 to C18 alcohol ethoxylate (5 EO) |

TABLE 2

Emulsifying properties with ethanol (=100% by weight of the working medium)

| Formulation | By weight: %1 | Emulsifying |
|---|---|---|
| PA08 | 40.0 | 3 |
| PA040 | 58.0 | |
| E Emulsifier 1 | 2.0 | |
| PA08 | 40.0 | 2 |
| PA040 | 59.5 | |
| Emulsifier 1 | 0.5 | |
| PA08 | 40.0 | 3 |
| PA040 | 59.0 | |
| Emulsifier 2 | 1.0 | |
| PA08 | 40.0 | 2 |
| PA040 | 59.0 | |
| Emulsifier 3 | 1.0 | |
| PA08 | 40.0 | 2 |
| PA040 | 59.0 | |
| Emulsifier 4 | 1.0 | |

TABLE 3

Emulsifying properties with acetone (=100% by weight of the working medium)

| Formulation | % | Emulsifying properties |
|---|---|---|
| PA08 | 40.0 | 2 |
| PA040 | 58.0 | |
| Emulsifier 1 | 2.0 | |

TABLE 4

Emulsifying properties with ethanol/water 50% by weight of ethanol and 50% by weight of water

| Formulation | [%] | Emulsifying properties |
|---|---|---|
| PA08 | 40.0 | 3 |
| PA040 | 58.0 | |
| Emulsifier 1 | 2.0 | |
| PA08 | 40.0 | 3 |
| PA040 | 59.0 | |
| Emulsifier 2 | 1.0 | |
| PA08 | 40.0 | 2 |
| PA040 | 59.0 | |
| Emulsifier 3 | 1.0 | |
| PA08 | 40.0 | 2 |
| PA040 | 59.0 | |
| Emulsifier 5 | 1.0 | |

TABLE 5

| Emulsifying properties with acetone/water 50% by weight of acetone and 50% by weight of water | | |
|---|---|---|
| Formulation | [%] | Emulsifying properties |
| PA08 | 40.0 | 3 |
| PA040 | 58.0 | |
| Emulsifier 1 | 2.0 | |
| PA08 | 40.0 | 2 |
| PA040 | 59.0 | |
| Emulsifier 2 | 1.0 | |
| PA08 | 40.0 | 2 |
| PA040 | 59.0 | |
| Emulsifier 3 | 1.0 | |
| PA08 | 40.0 | 3 |
| PA040 | 59.0 | |
| Emulsifier 5 | 1.0 | |

TABLE 6

| Emulsifying properties with ethanol/acetone 50% by weight of ethanol and 50% by weight of acetone | | |
|---|---|---|
| Formulation | [%] | Emulsifying properties |
| PA08 | 40.0 | 3 |
| PA040 | 58.0 | |
| Emulsifier 1 | 2.0 | |
| PA08 | 40.0 | 2 |
| PA040 | 59.0 | |
| Emulsifier 2 | 1.0 | |
| PA08 | 40.0 | 2 |
| PA040 | 59.0 | |
| Emulsifier 3 | 1.0 | |

Autoclave test for determining thermal stability

In a pressure autoclave with a capacity of 300 ml, mixtures of 60 grams (40% by weight) of lubricant and 90 grams (60% by weight) of working medium were charged respectively. As a lubricant, 2 mineral oil variants were also examined with a viscosity at 40° C. of 150 $mm^2/s$ besides lubricant mixtures on the basis of PAO. To remove the above atmosphere, in particular to remove the oxygen, the autoclave was evacuated for 30 seconds at a pressure of 500 mbar and was subsequently heated under magnetically induced stirring with an agitator at 250° C.

After 28 days, the experiment was completed at 250° C. After cooling the autoclave to 20° C. the content was transferred to a separatory funnel. After a rest period of 2 hours, the re-separated phases were separated and the lubricant and working medium were tested individually for acidification. The acid numbers were determined in accordance with DIN ISO 6618. Tables 7 to 9 show the results of autoclave experiments.

TABLE 7

| Autoclave test with ethanol | | | |
|---|---|---|---|
| | | Neutralization number [mg KOH/g] | |
| Lubricant | [%] | Lubricant | Working medium |
| PA08 | 40.0 | 0.01 | 0.04 |
| PA040 | 60.0 | | |
| PA08 | 40.0 | 0.01 | 0.02 |
| PA040 | 59.8 | | |
| Emulsifier 2 | 0.2 | | |

TABLE 7-continued

| Autoclave test with ethanol | | | |
|---|---|---|---|
| | | Neutralization number [mg KOH/g] | |
| Lubricant | [%] | Lubricant | Working medium |
| PA08 | 40.0 | 0.01 | 0.06 |
| PA040 | 58.0 | | |
| Emulsifier 2 | 2.0 | | |
| SN 900 F (H + R, V40 - 210 $mm^2/s$) | 99.8 | 0.02 | 0.04 |
| Emulsifier 1 | 0.2 | | |
| SN 600 (AP/E Core 600, Exxon Mobil) | 76.0 | 0.01 | 0.02 |
| Brightstock (AP/E Core 2500 ExxonMobil) | 23.8 | | |
| Emulsifier 1 | 0.2 | | |

TABLE 8

| Autoclave test with ethanol/water 50% by weight of ethanol and 50% by weight of water | | | |
|---|---|---|---|
| | | Neutralization number [mg KOH/g] | |
| Lubricant | [%] | Lubricant | Working medium |
| PA08 | 40.0 | 0.01 | 0.04 |
| PA040 | 60.0 | | |

TABLE 9

| Autoclave test with acetone | | | |
|---|---|---|---|
| | | Neutralization number [mg KOH/g] | |
| Lubricant | [%] | Lubricant | Working medium |
| PA08 | 40.0 | 0.02 | 0.05 |
| PA040 | 58.0 | | |
| Emulsifier 2 | 2.0 | | |

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the structures and the combination of the individual elements may be resorted to without departing from the spirit and scope of the invention.

The invention claimed is:

1. A working fluid composition comprising:

(a) at least one working medium (a) consisting of:

(a.1) at least one C1 to C4 alcohol, or (a.2) at least one C3 to C4 ketone or mixtures of (a1) and (a2), and (a.3) optionally up to 75% by weight of water, preferably up to 50% by weight of water, based on the working medium; and (b) at least one lubricant consisting of hydrocarbons, wherein the lubricant has a kinematic viscosity of 40 to 700 $mm^2/s$ at 40° C., measured according to DIN EN ISO 3104, and wherein the proportion of the lubricant (b) on the working fluid composition is 1 to 25% by weight; and (c) at least one emulsifier (c), wherein the proportion of the at least one emulsifier is in total greater than 0.01 to 5% by weight, based on the at least one lubricant.

2. The working fluid composition according to claim 1, wherein the proportion of the working medium (a) on the working fluid is 99 to 60% by weight, preferably from 90 to 80% by weight.

3. The working fluid composition according to claim 1, wherein the lubricant (b) consisting of hydrocarbons has a kinematic viscosity of 150 to 300 $mm^2/s$ at 40° C. measured according to DIN EN ISO 3104.

4. The working fluid composition according to claim 1, wherein the lubricant (b) consisting of hydrocarbons has a boiling point, also based on a optionally present hydrocarbon mixture, of greater than 300° C. (determined by gas chromatography according to DIN51435).

5. The working fluid composition according to claim 1, wherein the lubricant is an alkylate, an alkylated naphthalene, a mineral oil, a poly-alpha-olefin (PAO) or their mixtures.

6. The working fluid composition according to claim 5, wherein the lubricant is a PAO or a mixture of PAOs, preferably combinations of low viscosity PAOs with each having a viscosity of 4 to 10 $mm^2/s$ at 100° C. and high viscosity PAOs, with each having a viscosity of 40 to 100 $mm^2/s$ at 100° C. measured in each case according to DIN EN ISO 3104.

7. The working fluid composition according to a claim 1, wherein the proportion of lubricant (b) on the working fluid composition is 5 to 25% by weight, preferably 10 to 20% by weight.

8. The working fluid composition according to claim 1, wherein the lubricant is soluble to less than 5% by weight, preferably less than 2% by weight at 25° C. within the working medium.

9. The working fluid composition according to claim 1, wherein the emulsifier (c) is selected from the group of:

one or more alkenyl succinimides, preferably with molecular weight of 500 to 10000 g/mol (number average);

one or more alkenyl succinamides, preferably with molecular weight of 500 to 10000 g/mol;

one or more C8 to C24, preferably C10 to C18 fatty alcohol ether carboxylic acids with 2 to 10, preferably 4 to 8, alkoxylate units, particularly preferably ethylene oxide and/or propylene oxide units, and their salts, preferably ammonium salts;

one or more alkoxylated C10 to C24, preferably C8 to C24 fatty alcohols with 2 to 10, preferably 4 to 8, alkoxylate units, particularly preferably ethylene oxide and/or propylene oxide units;

one or more alkoxylated alkylphenols, in particular C6 to C18 alkyl, with 2 to 10, in particular 4 to 8, alkoxylate units, particularly preferably ethylene oxide and/or propylene oxide units;

and mixtures thereof.

10. The working fluid composition according to claim 9, wherein the proportion of the emulsifiers is in total greater than 0.0001 to 2% by weight, based on the working fluid composition.

11. The working fluid composition according to claim 1, wherein the working fluid composition as other optional components (d) contains antiwear agents, extreme pressure additives, antioxidants, nonferrous metal inhibitors, defoamers, or their mixtures.

12. The working fluid composition according to claim 11, wherein the proportion of the optional further components (d) together is greater than 0.0001% by weight, preferably 0.0005 to 2% by weight, in each case based on the working fluid composition.

13. The working fluid composition according to claim 11, wherein the proportion of the optional further components (d) together is independently, but preferably cumulatively, greater than 0.01% by weight, particularly preferably 0.1 to 5% by weight based on the lubricant.

14. The working fluid composition according to claim 1, wherein the working composition contains 5 to 75% by weight water, particularly 10 to 50% by weight water within the working medium.

15. A device for a steam cycle process comprising at least an evaporator, an expander, a condenser and a circulation pump, and a working fluid composition comprising:

(a) at least one working medium (a) consisting of:

(a.1) at least one C1 to C4 alcohol, or (a.2) at least one C3 to C4 ketone or mixtures of (a1) and (a2), and (a.3) optionally up to 75% by weight of water, preferably up to 50% by weight of water, based on the working medium; and (b) at least one lubricant consisting of hydrocarbons, wherein the lubricant has a kinematic viscosity of 40 to 700 $mm^2/s$ at 40° C., measured according to DIN EN ISO 3104, and wherein the proportion of the lubricant (b) on the working fluid composition is 1 to 40% by weight; and (c) at least one emulsifier (c), wherein the proportion of the at least one emulsifier is in total greater than 0.01 to 5% by weight, based on the at least one lubricant.

16. The device according to claim 15, wherein the steam cycle process is part of a motor vehicle with an internal combustion engine, and a heat exchanger uses the waste heat of the engine and is preferably coupled to the exhaust gas system of the engine and the heat exchanger acts as an evaporator.

17. The device according to claim 15, wherein the mechanical power recovered by the expander is either coupled to the drive train of the motor vehicle, or drives a generator for generating electrical energy.

18. A method comprising:

utilizing the working fluid composition according to claim 1 in an organic Rankine cycle.

* * * * *